US005355788A

United States Patent [19]

Phinney

[11] Patent Number: 5,355,788

[45] Date of Patent: Oct. 18, 1994

[54] OPPOSED BELT CAN COMPACTOR APPARATUS

[76] Inventor: Randall B. Phinney, 715 Bishop, Salina, Kans. 67401

[21] Appl. No.: 63,726

[22] Filed: May 20, 1993

[51] Int. Cl.[5] ..... B30B 15/14; B30B 5/06

[52] U.S. Cl. ..... 100/49; 100/98 R; 100/152; 100/902; 241/36; 241/200

[58] Field of Search ..... 100/49, 151, 152, 902, 100/98 R, 96; 241/36, 99, 100, 200

[56] References Cited

U.S. PATENT DOCUMENTS

| | | | |
|---|---|---|---|
| 1,609,523 | 12/1926 | McLaughlin | 100/98 R |
| 2,603,270 | 7/1952 | Voigt et al. | 100/902 X |
| 2,638,957 | 5/1953 | Danielson | 100/902 X |
| 3,010,665 | 11/1961 | Smith | 241/99 X |
| 3,411,722 | 11/1968 | Webber | 100/902 X |
| 3,645,199 | 2/1972 | Kanna | 100/49 X |
| 3,691,942 | 9/1972 | Wagley | 100/151 |
| 4,291,618 | 9/1981 | Heiser et al. | 100/902 X |
| 4,358,994 | 11/1982 | Talley | 100/902 X |
| 4,443,697 | 4/1984 | Ryan et al. | 100/902 X |
| 4,501,198 | 2/1985 | Johansson et al. | 100/98 R |
| 4,532,859 | 8/1985 | Solordal | 100/902 X |
| 4,995,314 | 2/1991 | Buer | 100/152 |
| 5,048,413 | 9/1991 | Deiters | 100/902 X |
| 5,158,013 | 10/1992 | Morris | 100/902 X |

FOREIGN PATENT DOCUMENTS

| | | | |
|---|---|---|---|
| 62-199296 | 9/1987 | Japan | 100/902 |
| 63-180398 | 7/1988 | Japan | 100/902 |
| 2-41798 | 2/1990 | Japan | 100/902 |
| 3-118996 | 5/1991 | Japan | 100/902 |
| 576357 | 11/1977 | U.S.S.R. | 100/152 |
| 22060 | of 1908 | United Kingdom | 100/151 |
| 2011302 | 7/1979 | United Kingdom | 100/902 |

*Primary Examiner*—Stephen F. Gerrity
*Attorney, Agent, or Firm*—Litman, McMahon & Brown

[57] ABSTRACT

A can compactor includes an electric motor connected to drive a chain which, in turn, drives a pair of crushing belts arranged in opposing fashion to form a V. One of the belts is driven clockwise while the other belt is driven counterclockwise. Cans to be crushed are placed through a guide in an open area at the top of the two belts, where they break a light beam, triggering a photosensitive switch, which starts the motor. A normally closed limit switch is placed in close proximity to the chain drive, and a special link on the chain is positioned to engage the limit switch to open the normally closed switch, and thus stop the motor after a single revolution of the chain. This is sufficient time for the crusher belts to thoroughly flatten the can. Can gripping lugs on at least one of the belts assure that the cans are positively fed through the mechanism and out the bottom of the V.

9 Claims, 2 Drawing Sheets

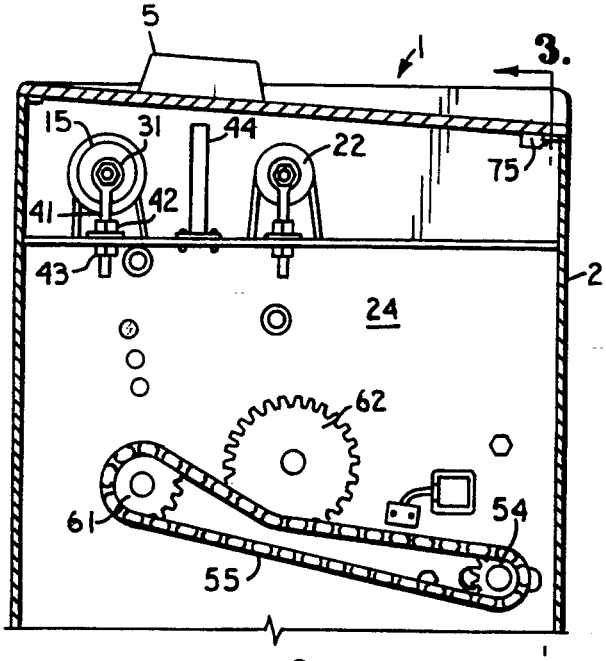
Fig. 2.
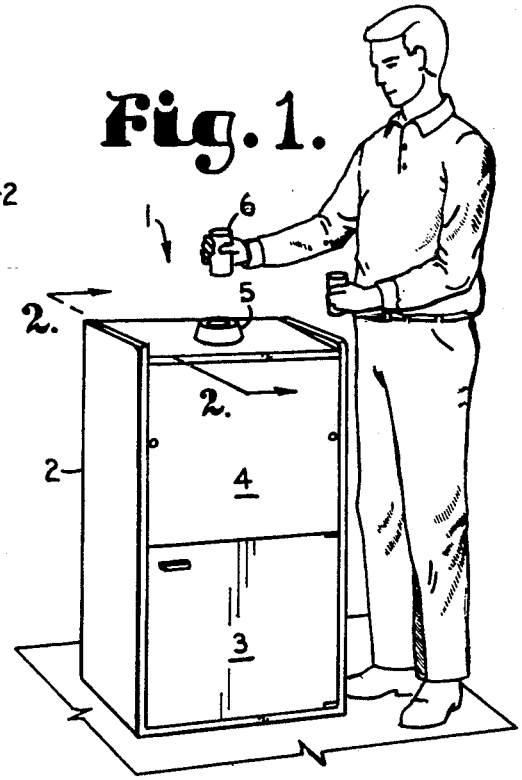
Fig. 1.
Fig. 4.
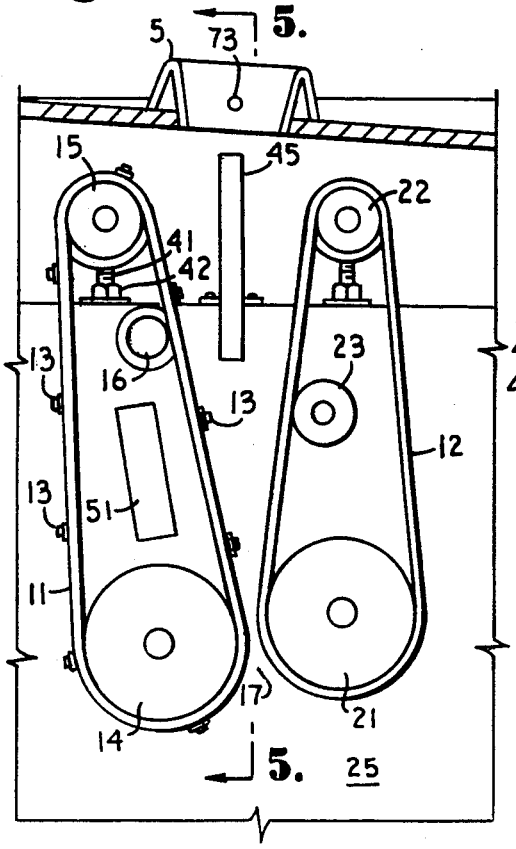
Fig. 5.
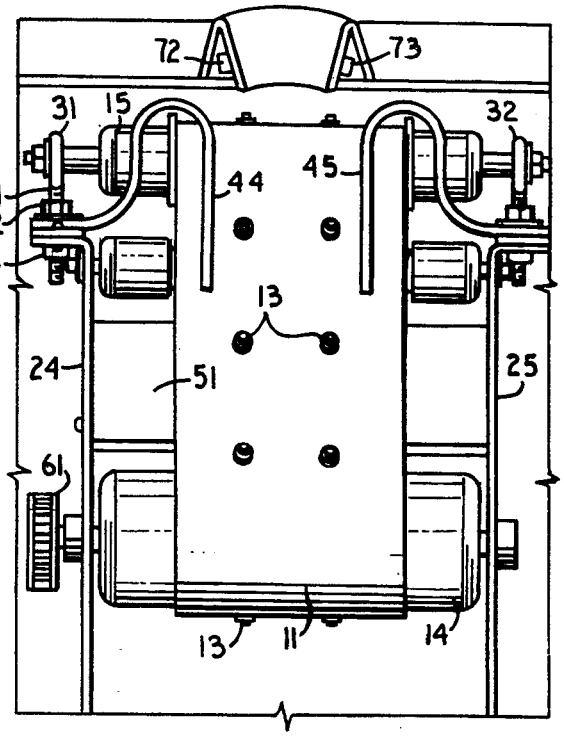

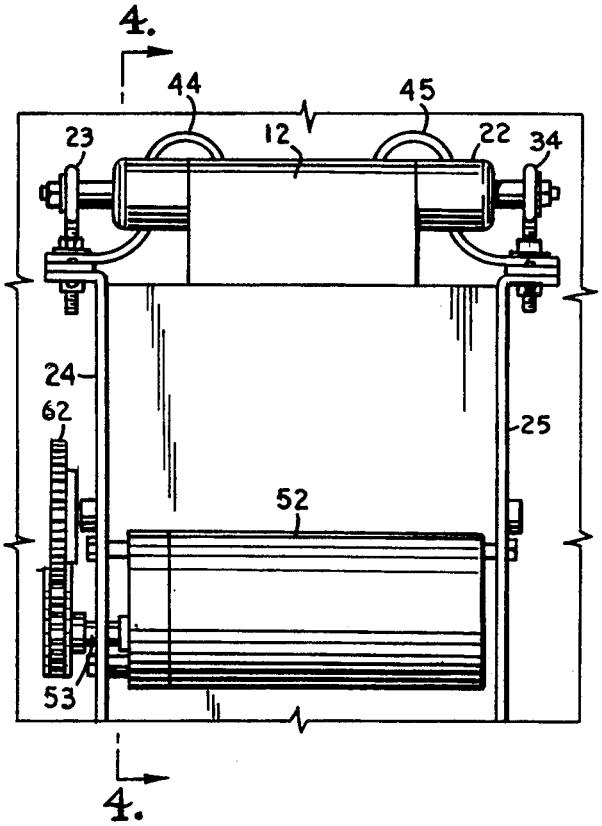
Fig.3.
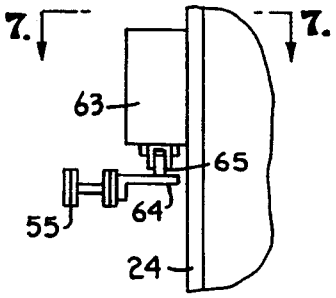
Fig.6.
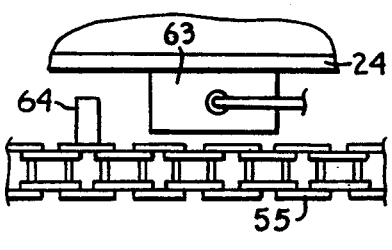
Fig.7.
Fig.8.
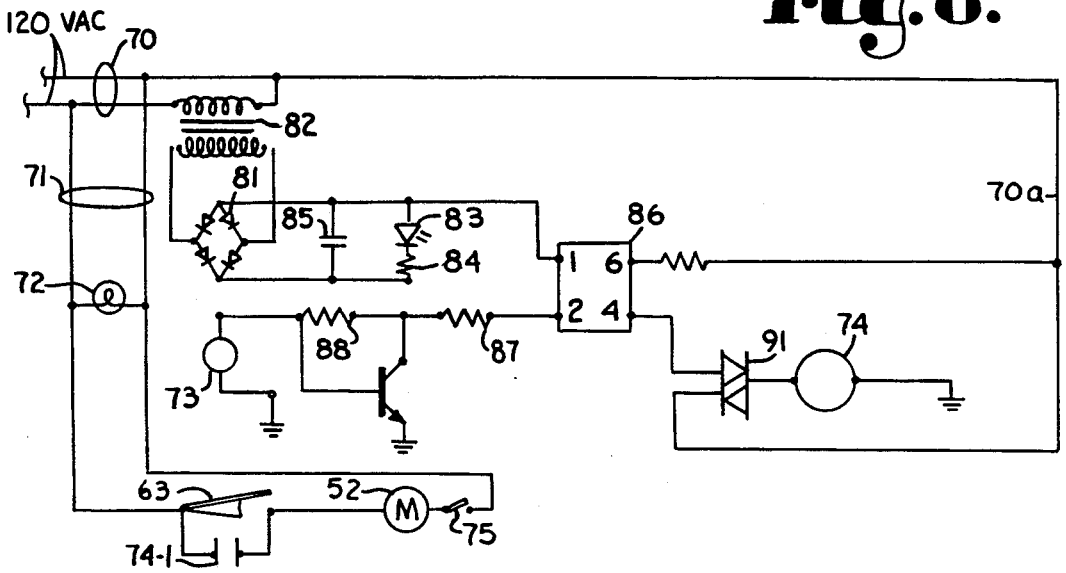

OPPOSED BELT CAN COMPACTOR APPARATUS

BACKGROUND OF THE INVENTION

1. Field of the Invention

The present invention relates to an can compactor apparatus for crushing aluminum beverage cans or the like to reduce their volume and facilitate storage and recycling operations, and more particularly to such an apparatus which employs a set of opposed, electrically driven crusher belts which collectively form a V, and which are operative to crush a can inserted between the belts.

2. Description of the Related Art

Recent emphasis on environmental concerns, such as decreasing land fill space, diminishing supplies of natural resources, conservation of energy and minimizing land disturbance due to mining operations, has resulted in increased recycling operations. One of the most economically viable materials to recycle is aluminum and aluminum beverage cans represent the bulk of consumer recyclable aluminum.

One problem with recycling aluminum cans is the large volume which such cans occupy compared to their aluminum content. The obvious solution to this problem is to provide a can compactor which is capable of efficiently and completely flattening large numbers of such cans.

Numerous attempts have been made to produce such a can compactor. One approach has been to use a hand-operated lever system for manually crushing a can. This type of crusher is generally designed for occasional, in home use. Generally, a considerable amount of force is required to operate such crushers, which limits their use to physically able people. Furthermore, the cans must be loaded, crushed and removed one-by-one by hand, thus making it time consuming and laborious to manually process large numbers of cans.

To solve these problems, a number of motorized can crushers have been designed with a variety of configurations.

For example, U.S. Pat. No. 4,291,618 to Heiser, et al. teaches a piston-like plunger which first creases and then thoroughly crushes a can inserted therein. The plunger can be manually or power driven.

U.S. Pat. No. 4,358,994 to Talley is another two-stage creasing and crushing apparatus in which a motor driven piston contacts a can inserted within a closed housing.

U.S. Pat. No. 5,048,413 to Deiters teaches a motor-driven single action can crusher associated with a waste receptacle. Whole cans inserted into a closed housing rest on a shelf with an opening sized to support an uncrushed can but allow a crushed can to fall through into the waste receptacle.

Each of these crushers uses a reciprocating piston with all of the problems inherent in such a system, including undue wear and tear on the machinery and the resulting increased maintenance caused thereby.

It is clear then that a need still exists for a motorized can compactor which requires little or no maintenance. Such a can compactor should be compact and relatively inexpensive, capable of unobtrusive display and use, and should be able to efficiently process numerous aluminum cans in a short time. In addition, the compactor should include safety features which prevent or minimize any danger to a person using the compactor.

SUMMARY OF THE INVENTION

In the practice of the present invention, an electric motor drives a chain which, in turn drives a pair of crushing belts arranged in opposing fashion to form a V. One of the belts is driven clockwise while the other belt is driven counterclockwise. Cans to be crushed are placed through a guide in an open area between the two belts, where they break a light beam, triggering a photosensitive switch. The switch engages a relay which closes a normally open relay contact to momentarily provide power to the motor. A normally closed limit switch is placed in close proximity to the chain drive, and a special link on the chain is positioned to engage the limit switch to open the normally closed switch after a single revolution of the chain. The limit switch is placed in parallel with the normally open relay contact with the net effect being that the motor drives the chain through a single revolution in response to a can being placed in the mechanism. This is sufficient time for the crusher belts to thoroughly flatten the can. A number of gripping lugs on one of the belts insure that each can is efficiently fed through the compactor.

OBJECTS AND ADVANTAGES OF THE INVENTION

The principle objects and advantages of the invention include: to provide a can compactor apparatus which is motor driven; to provide such an apparatus which includes a can guide with a light sensitive switch positioned therein which is operative to drive a relay to start the motor; to provide such an apparatus which uses two crushing belts arranged opposite each other to form a V; to provide such an apparatus in which the crushing belts are driven in opposite directions by a chain drive connected to the motor; to provide such an apparatus in which a limit switch is arranged in close proximity to the chain drive; to provide such an apparatus in which the limit switch limits the motor to a single chain revolution per can; to provide such an apparatus in which at least one of the crushing belts is equipped with can gripping lugs to pull each can in between the belts to assure that it is thoroughly crushed; and to provide such an apparatus which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a can compactor apparatus in accordance with the present invention, with the crushing mechanism placed in a closed receptacle.

FIG. 2 is an enlarged, cross-sectional view of the compactor mechanism, taken along line 2—2 of FIG. 1, and illustrating a chain drive.

FIG. 3 is an enlarged, cross-sectional view of the compactor mechanism, taken along line 3—3 of FIG. 2, illustrating the drive motor placement.

FIG. 4 is an enlarged, cross-sectional view of the compactor mechanism, taken along line 4—4 of FIG. 3, illustrating the V arrangement of the crusher belts.

FIG. 5 is an enlarged, cross-sectional view of the compactor mechanism, taken along line 5—5 of FIG. 4, illustrating a can guide and a plurality of can gripping lugs on one of the crusher belts.

FIG. 6 is a further enlarged, fragmentary view of a limit switch and a switch actuator attached to the drive chain.

FIG. 7 is a further enlarged, fragmentary cross-sectional view of the limit switch, taken along line 7—7 of FIG. 6.

FIG. 8 is an electrical schematic of the can compactor apparatus.

DETAILED DESCRIPTION OF THE INVENTION

I. Introduction and Environment

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1-5, a can compactor apparatus in accordance with the invention is generally indicated at 1. The compactor 1 comprises a housing 2, which has an appearance similar to an ordinary trash receptacle with a hinged door 3 at the bottom and a removable access panel 4 which permits access to the compactor 1. A circular inlet 5 is provided in the top of the housing 2, which inlet 5 can be sized to admit a single aluminum can, such as the can 6.

II. Can Compactor Belt Assembly

The can compactor 1 comprises a pair of opposed endless belts 11 and 12, which are arranged at respective angles such that they collectively form a V. The belt 11 includes a plurality of gripping lugs 13 arrayed in pairs thereon, and the belt 11 encircles a bottom roller 14 and a top roller 15, with an idling roller 16 positioned therebetween. Likewise, the belt 12 encircles a bottom roller 21 and top roller 22, with an idling roller 23 positioned therebetween. The belts 11 and 12 are spaced sufficiently to leave a gap 17 therebetween at their closest point. The bottom and idling rollers 14, 16, 21 and 23 extend between a pair of support plates 24 and 25, while the top roller 15 is supported between eyelets 31 and 32 and the top roller 22 is supported between eyelets 33 and 34. The eyelets 31-34 are attached to top flanges 35 or 36 of the support plates 24 and 25, respectively. Each of the eyelets 31-34 is vertically adjustable via a threaded support rod and nuts such as the rod 41 and nuts 42 and 43 of eyelet 31. This eyelet vertical adjustment is provided for belt tensioning.

A pair of can guides 44 and 45 are attached to the flanges 35 and 36, respectively, to assure that each can 6 is inserted vertically in between the belts 11 and 12. A rigidizing support 51 is bolted between the support plates 24 and 25 to limit any inward or outward flexing of the plates 24 and 25 relative to each other.

III. Compactor Motor Drive and Electrical Schematic

An electric motor 52 (FIG. 3) is attached between the support plates 24 and 25. The motor 52 includes a drive shaft 53 connected to a motor drive sprocket 54. An endless drive chain 55 is connected between the drive sprocket 54 and a roller sprocket 61, which drives the bottom roller 14. The chain 55 also drives a sprocket 62 which is positioned above the chain 55. The sprocket 62 is connected to drive the bottom roller 21. Referring to FIG. 2, the motor drive sprocket 54 is turned in a clockwise direction, thus causing the chain 55 and the sprocket 61 to also turn in a clockwise direction. Conversely, the chain 55 drives the sprocket 62 in a counterclockwise direction. Thus, referring to FIG. 4, the belt 11 is turned in a clockwise direction while the belt 12 is turned in a counterclockwise direction. Furthermore, the difference in sizes between the sprockets 61 and 62 causes the belts 11 and 12 to turn at different speeds, thus creating powerful shearing forces which act on each can 6 when it is inserted therebetween.

Referring to FIGS. 6 and 7, a limit switch 63 is positioned in close proximity to the chain 55. A special extended link 64 in the chain 55 is adapted to contact a switch feeler 65 each time the chain 55 makes one complete revolution.

Referring to FIG. 8, an electrical schematic for the compactor 1 is illustrated. Conventional 120 V AC power is supplied via wire pairs 70 and 71 to a lamp 72 which is positioned in the can inlet 5 opposite a photosensing switch 73 (FIGS. 4 and 5). Power is also supplied to the motor 52 via the wire pair 71 and via the normally closed limit switch 63 connected in parallel with a normally open relay contact 74-1 of a relay 74. A door safety switch 75 (FIG. 2) is placed in series with the motor 52 to insure that the compactor 1 will not operate when the access door 4 is opened.

AC power is also supplied to a rectifier bridge 81 via a transformer 82, to supply a 12 volt rectified DC voltage to an indicator LED 83 placed in series with a resistor 84 and in parallel across a capacitor 85, and to pin 1 of a TRIAC driver 86, which may comprise an MDC 3011 integrated circuit. Pin 2 of the TRIAC driver 86 is connected to a collector of a transistor TR1 via a resistor 87. The TR1 collector is also connected to the photosensitive switch 73 via a resistor 88 while the TR1 emitter is directly coupled to the photosensitive switch 73. Pin 6 of the TRIAC driver 85 is connected to a hot lead 70*a* of the wire pair 70 while pin 4 is connected to the gate of a triac 91, which is connected in series between the hot lead 70*a* and the relay 74.

IV. Operation

The operation of the compactor 1 will now be described with reference to FIGS. 1-8. Each can 6, when placed within the can inlet 5, momentarily blocks light from the lamp 72 from reaching the sensor 73, thus switching off the sensor 73. This causes the transistor TR1 to conduct, triggering a gating voltage at pin 4 of the TRIAC driver 85. This gating voltage triggers the TRIAC 91 into conduction for a half cycle of the AC current on wire pair 70. Thus, the relay 74 is temporarily enabled, closing normally opened contacts 74-1 and supplying power to the motor 52. The motor 52 advances the chain 55, removing the special link 64 from contact with the switch feeler 65, and closing the normally closed limit switch 63, which continues to provide power to the motor 52.

The can 6 is fed through the guides 44 and 45 via gravity and is drawn between the rollers 11 and 12 via the gripping lugs 13. The combined action of the V arrangement of the belts 11 and 12, the gripping lugs 13, and the shear forces created by the different belt speeds thoroughly crush and compact the can 6. Once compacted, the can 6 drops out of the opening 17 at the bottom between the belts 11 and 12, and falls into the bottom of the housing 2. After the chain 55 completes one full cycle, the special link 64 again contacts the feeler 65, opening the switch 63 and removing power to the motor 52. This chain cycle is long enough to insure that each can 6 is thoroughly crushed and deposited into the housing 2. Insertion of additional cans 6 repeat the cycle. The door safety switch 75 insures that power is removed from the motor 52 should the access panel 4 be removed while the motor 52 is operating.

In a preferred embodiment of the compactor 1, the following circuit elements were used in the circuit of FIG. 8, which specific elements should be considered as representative only:

Capacitor 85: 100UF
Resistor 85: 1K OHM
Resistor 87: 1K OHM
Resistor 88: 499K OHM
Transistor TR1: 2N4401
TRIAC 91:2N6073

It is to be understood that while certain forms of the present invention have been illustrated and described herein, it is not to be limited to the specific forms or arrangement of parts described and shown.

What is claimed and desired to be secured by Letters Patent is as follows:

1. A can compactor apparatus comprising:

(a) a compactor means comprising first and second crusher belt arranged in opposition to each other and at respective angles to form a V; each of said first and second crusher belts comprising an endless belt encircling a respective pair of rollers, with one of the rollers in each crusher belt being a drive roller;

(b) an electric motor driving a chain which, in turn, drives said drive rollers via connected sprockets to crush a can placed into the top portion of the V and to expel the crushed can out the bottom portion of the V, said chain means driving said drive rollers such that said first belt is driven in a first direction about said rollers while said second belt is driven in the opposite direction, and said chain driving said first and second belts at different speeds;

(c) a plurality of gripping lugs positioned on at least one of said first and second belts, said gripping lugs being adapted to grip said can and pull it between said belts;

(d) a normally closed limit switch positioned in close proximity to said chain, said limit switch being placed in series with said motor, said limit switch including a feeler;

(e) said chain including a special link adapted to engage said feeler on said limit switch during each cycle of said chain, said limit switch shutting off power to said motor when said feeler is so engaged;

(f) a housing surrounding said can compactor;

(g) an inlet through said housing sized and positioned to permit the introduction of cans to be compacted into said housing;

(h) a lamp and a photosensor positioned at opposite sides of said inlet, said introduced cans momentarily shielding said photosensor to block light from said lamp;

(i) a relay means with a normally open relay contact positioned in parallel with said limit switch; and (j) switching means responsive to blockage of light from said photosensor to momentarily operate said relay to provide power to said motor when one of said cans is introduced into said inlet.

2. A can compactor apparatus comprising:

(a) a compactor means arranged in a V configuration with a wide top portion and a narrow bottom portion, said compactor means comprising first and second crusher belts arranged in opposition to each other and at respective angles to form said V, said first and second drive belts being connectd to respective drive rollers;

(b) electric motor means for driving a chain which, in turn, drives said drive rollers via connected sprockets to drive said first and second belts in opposite directions to thereby crush cans placed into the top portion of the V and to expel the crushed cans out the bottom portion of the V;

(c) a normally closed limit switch positioned in close proximity to said chain, said limit switch being placed in series with said motor, said limit switch including a feeler; and (d) said chain including a special link adapted to engage said feeler on said limit switch during each cycle of said chain, said limit switch shutting off power to said motor when said feeler is so engaged.

3. A can compactor apparatus comprising:

(a) a compactor means arranged in a V configuration with a wide top portion and a narrow bottom portion, said compactor means comprising first and second crusher belts arranged in opposition to each other and at respective angles to form said V, said first and second drive belts being connected to respective drive rollers;

(b) electric motor means connected via a drive means for driving said drive rollers to drive said first and second belts in opposite directions to thereby crush cans placed into the top portion of the V and to expel the crushed cans out the bottom portion of the V;

(c) a housing surrounding said can compactor apparatus;

(d) an inlet through said housing sized and positioned to permit the introduction of cans to be compacted into said housing;

(e) a lamp and a photosensor positioned at opposite sides of said inlet, said introduced cans momentarily shielding said photosensor to block light from said lamp;

(f) a limit switch positioned in close proximity to said drive means for switching power to said motor dependent upon the position of said drive means;

(f) a relay means with a normally open relay contact positioned in parallel with said limit switch; and (g) switching means responsive to blockage of light from said photosensor to momentarily operate said relay to provide power to said motor when one of said cans is introduced into said inlet.

4. A can compactor apparatus as in claim 3, wherein:

(a) each of said first and second crusher belts comprises an endless belt encircling a respective pair of rollers, with one of the rollers in each crusher belt being a drive roller driven by said means for driving.

5. A can compactor apparatus as in claim 4, wherein:

(a) said first and second belts are driven at different speeds.

6. A can compactor apparatus as in claim 4, wherein:

(a) said drive means comprises a chain which, in turn, drives said drive rollers via connected sprockets.

7. A can compactor apparatus comprising:

(a) a compactor means comprising first and second crusher belts arranged in opposition to each other and at respective angles to form a V; each of said first and second crusher belts comprising an endless belt encircling a respective pair of rollers, with one of the rollers in each crusher belt being a drive roller;

(b) an electric motor means driving a chain which, in turn, drives said drive rollers via connected sprockets to crush a can placed into the top portion of the V and to expel the crushed can out the bottom portion of the V, said motor means driving said drive rollers such that said first belt is driven in a first direction about said rollers while said second belt is driven in the opposite direction;

(c) a normally closed limit switch positioned in close proximity to said chain, said limit switch being placed in series with said motor, said limit switch including a feeler; and (d) said chain including a special link adapted to engage said feeler on said limit switch during each cycle of said chain, said limit switch shutting off power to said motor when said feeler is so engaged.

8. A can compactor apparatus as in claim 7, wherein:

(a) said first and second belts are drive at different speeds.

9. A can compactor apparatus as in claim 7, and further comprising:

(a) a housing surrounding said can compactor;

(b) an inlet through said housing sized and positioned to permit the introduction of cans to be compacted into said housing;

(c) a lamp and a photosensor positioned at opposite sides of said inlet, said introduced cans momentarily shielding said photosensor to block light from said lamp;

(d) a relay means with a normally open relay contact positioned in parallel with said limit switch; and (e) switching means responsive to blockage of light from said photosensor to momentarily operate said relay to provide power to said motor when one of said cans is introduced into said inlet.

* * * * *